US006737109B2

(12) United States Patent
Stanton et al.

(10) Patent No.: US 6,737,109 B2
(45) Date of Patent: May 18, 2004

(54) METHOD OF COATING AN EJECTOR OF AN INK JET PRINTHEAD

(75) Inventors: Donald S. Stanton, Penfield, NY (US); David H. Pan, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 242 days.

(21) Appl. No.: 09/682,910

(22) Filed: Oct. 31, 2001

(65) Prior Publication Data

US 2003/0081063 A1 May 1, 2003

(51) Int. Cl.[7] ..... B05D 7/22; B05D 5/08

(52) U.S. Cl. ..... 427/235; 427/230; 427/236; 427/238; 427/239; 427/294; 427/295; 427/350; 427/356; 427/388.1; 427/409; 427/421; 347/45

(58) Field of Search ..... 347/45, 44, 20; 427/294, 350, 421, 230, 236, 238, 407.1, 385.5, 393.6, 239, 235, 295, 356, 388.1, 409

(56) References Cited

U.S. PATENT DOCUMENTS

| | | | | |
|---|---|---|---|---|
| 3,946,398 | A | | 3/1976 | Kyser et al. |
| 4,308,547 | A | | 12/1981 | Lovelady et al. |
| 4,643,948 | A | | 2/1987 | Diaz et al. |
| 4,697,195 | A | | 9/1987 | Quate et al. |
| 4,751,529 | A | | 6/1988 | Elrod et al. |
| 4,751,530 | A | | 6/1988 | Elrod et al. |
| 4,751,534 | A | | 6/1988 | Elrod et al. |
| 4,797,693 | A | | 1/1989 | Quate |
| 4,801,953 | A | | 1/1989 | Quate |
| 5,028,937 | A | | 7/1991 | Khuri-Yakub et al. |
| 5,041,849 | A | | 8/1991 | Quate et al. |
| 5,111,220 | A | | 5/1992 | Hadimioglu et al. |
| 5,121,141 | A | | 6/1992 | Hadimoglu et al. |
| 5,212,496 | A | | 5/1993 | Badesha et al. |
| 5,451,992 | A | | 9/1995 | Shimomura et al. |
| 5,502,470 | A | * | 3/1996 | Miyashita et al. ..... 347/45 |
| 5,677,719 | A | | 10/1997 | Granzow |
| RE35,737 | E | | 2/1998 | Sourlis et al. |
| 5,796,415 | A | * | 8/1998 | Inoue et al. ..... 347/45 |
| 6,000,783 | A | * | 12/1999 | Takemoto et al. ..... 347/45 |
| 6,116,718 | A | | 9/2000 | Peeters et al. |
| 6,123,415 | A | | 9/2000 | Nagato et al. |
| 6,126,269 | A | * | 10/2000 | Takemoto et al. ..... 347/45 |
| 6,193,352 | B1 | * | 2/2001 | Sharma et al. ..... 347/28 |
| 6,199,970 | B1 | | 3/2001 | Roy et al. |
| 6,217,160 | B1 | | 4/2001 | Reiten et al. |
| 6,255,383 | B1 | | 7/2001 | Hanzlik |
| 6,467,876 | B1 | * | 10/2002 | Karasawa et al. ..... 347/45 |
| 2002/0135636 | A1 | * | 9/2002 | Miyakawa et al. ..... 347/45 |

FOREIGN PATENT DOCUMENTS

| | | |
|---|---|---|
| EP | 0 359 365 | 3/1990 |

OTHER PUBLICATIONS

IBM Technical Disclosure Bulletin, vol. 16, No. 4, Sep. 1973, pp. 1168–1170.

* cited by examiner

*Primary Examiner*—Michael Barr
*Assistant Examiner*—Kirsten Crockford Jolley
(74) *Attorney, Agent, or Firm*—Oliff & Berridge, PLC

(57) ABSTRACT

A method for coating an ink jet printhead with an ink-phobic coating includes applying the coating to an outer surface of the printhead and then drawing or forcing the coating through the apertures of the printhead, preferably with a vacuum. The method coats and renders ink-phobic not only the outer surface, but also the inside surfaces of the apertures. The ink-phobic coating may contain an amorphous fluoropolymer.

19 Claims, 2 Drawing Sheets

METHOD OF COATING AN EJECTOR OF AN INK JET PRINTHEAD

BACKGROUND OF THE INVENTION

1. Field of Invention

This invention relates to a method of coating the ejector of an inkjet printhead and to the ejector surfaces so coated.

2. Description of Related Art

Acoustic inkjet printing processes are known. See, for example, U.S. Pat. No. 6,255,383 to Hanzlik, incorporated by reference herein in its entirety. As described therein, an acoustic beam exerts a radiation pressure against objects upon which it impinges. Thus, when an acoustic beam impinges on a free surface (i.e., liquid/air interface) of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. These principles have been applied to prior ink jet and acoustic printing proposals. For example, K. A. Krause, "Focusing Ink Jet Head," IBM Technical Disclosure Bulletin, Vol. 16, No. 4, September 1973, pp. 1168–1170, the disclosure of which is totally incorporated herein by reference, describes an ink jet in which an acoustic beam emanating from a concave surface and confined by a conical aperture is used to propel ink droplets out through a small ejection orifice.

Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure which each of the beams exerts against the free ink surface to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. Regardless of the timing mechanism employed, the size of the ejected droplets is determined by the waist diameter of the focused acoustic beam.

Acoustic ink printing is attractive because it does not require the nozzles or the small ejection orifices which have caused many of the reliability and pixel placement accuracy problems that conventional drop on demand and continuous stream ink jet printers have suffered from. The size of the ejection orifice is a critical design parameter of an ink jet because it determines the size of the droplets of ink that the jet ejects. As a result, the size of the ejection orifice cannot be increased, without sacrificing resolution. Acoustic printing has increased intrinsic reliability because there are no nozzles to clog. As will be appreciated, the elimination of the clogged nozzle failure mode is especially relevant to the reliability of large arrays of ink ejectors, such as page width arrays comprising several thousand separate ejectors. Furthermore, small ejection orifices are avoided, so acoustic printing can be performed with a greater variety of inks than conventional ink jet printing, including inks having higher viscosities and inks containing pigments and other particulate components. It has been found that acoustic ink printers embodying printheads comprising acoustically illuminated spherical focusing lenses can print precisely positioned pixels (i.e., picture elements) at resolutions which are sufficient for high quality printing of relatively complex images.

It has also has been discovered that the size of the individual pixels printed by such a printer can be varied over a significant range during operation, thereby accommodating, for example, the printing of variably shaded images. Furthermore, the known droplet ejector technology can be adapted to a variety of printhead configurations, including (1) single ejector embodiments for raster scan printing, (2) matrix configured ejector arrays for matrix printing, and (3) several different types of pagewidth ejector arrays, ranging from single row, sparse arrays for hybrid forms of parallel/serial printing to multiple row staggered arrays with individual ejectors for each of the pixel positions or addresses within a pagewidth image field (i.e., single ejector/pixel/line) for ordinary line printing.

Inks suitable for acoustic ink jet printing typically are liquid at ambient temperatures (i.e., about 25° C.), but in other embodiments the ink is in a solid state at ambient temperatures and provision is made for liquefying the ink by heating or any other suitable method prior to introduction of the ink into the printhead. Images of two or more colors can be generated by several methods, including by processes wherein a single printhead launches acoustic waves into pools of different colored inks. Further information regarding acoustic inkjet printing apparatus and processes is disclosed in, for example, U.S. Pat. Nos. 4,308,547, 4,697,195, 5,028,937, 5,041,849, 4,751,529, 4,751,530, 4,751,534, 4,801,953, and U.S. Pat. No. 4,797,693, the disclosures of each of which are totally incorporated herein by reference.

A major source of ink jet misdirection is associated with improper wetting of the surface of the acoustic ink jet printhead. One factor which adversely affects directional accuracy is the interaction of ink accumulating on the surface of the printhead with the ejected ink droplets. Ink may accumulate on the printhead surface after extended expelling of the droplets of ink from the printhead. When the accumulating ink on the printhead surface makes contact with ink to be expelled, a resulting imbalance of the forces acts on the ejecting ink, which in turn leads to misdirection of the ejected ink. This wetting phenomenon becomes more troublesome after extensive use as the array face oxidizes or becomes covered with a dried ink film, leading to a gradual deterioration of the image quality that the printhead is capable of generating. To retain good ink jet directionality, it is desirable to reduce the wetting of the surface of the printhead.

Thus, the construction and operation of an acoustic ink jet printhead requires that a hydrophobic coating be coated on the inside surfaces of the inkjet printhead such that inks in a solvent do not wet the surfaces of the construction. The ejector surfaces of the printhead must be uniformly coated with the hydrophobic coating material. A uniform thickness of the coating is preferred to provide predictable, accurate printing.

In U.S. Pat. No. 5,451,992 to Shimomura et al., an ink jet head is described that is subjected to a liquid repellency treatment. The liquid repellency treatment is applied to at least a peripheral portion of a discharge port of the ink jet head. A mixture of a fluorine-containing high polymer compound and a compound having fluorine substituted hydrocarbon group and a silazane group, alkoxysilane group or halogenized silane group is employed as a liquid repellent agent. Shimomura describes that an absorbing member is immersed in the liquid repellency agent. The absorbing member is then applied to the discharge port of the inkjet head, thereby coating the liquid repellency treating agent on the discharge port. TEFLON® AF is described as a possible fluorine-containing high polymer compound.

In U.S. Pat. No. 3,946,398 to Kyser et al., a recording apparatus and method is disclosed which includes feeding a writing fluid source to a drop projection means which ejects a series of droplets of writing fluid from a nozzle in a discontinuous stream with sufficient energy to traverse a substantially straight trajectory to a recording medium. Kyser describes that TEFLON® may be used to coat the ejection surface of the apparatus to maintain a contact angle of greater than 90° between the writing fluid and the ejection surface. Kyser does not describe how the TEFLON® coating is applied to the ejection surface.

In European Patent No. 0 359 365 to Anderson et al., a method of modifying an ink jet head comprising applying a layer of a coating material to the ink jet head to maintain a contact angle of at least about 50° at an operating temperature of at least about 70° C. is described. The coating material may contain fluorocarbon polymers such as TEFLON® PTFE (polytetrafluoroethylene) and TEFLON® PFA (polyperfluoroalkoxybutadiene). Methods to apply the coating material include dip, spray, spin coating, plasma polymerization and the use of electroless nickel. Anderson does not describe drawing the coating material through the interior of the inkjet head.

In U.S. Pat. No. 5,212,496 to Badesha et al., an ink jet recording head comprising a plurality of channels is described. The channels are capable of being filled with ink from an ink supply and terminate in nozzles on one surface of the printhead. The surface is coated with a polyimide-siloxane block copolymer. The coating material can be applied to the surface of the printhead by dissolving the polyimide-siloxane copolymer in a suitable solvent and applying the solution to the surface by spray coating, spin coating, contact coating by use of brushes, fine bristled brushes, rubber rollers, cotton, cloth or foam rubber and applicators, or hand coating with a swab such as a Q-TIP® and allowing the solution to evaporate. Examples of suitable solvents include dichloromethane, methyl ethyl ketone, tetrahydrofuran, and N-methylpyrrolidone.

In one embodiment, it is described to use pressurized gas to prevent the interior channel walls from becoming coated with the solution. It is further described that if ink-repellent material coats the walls of the channels, then the proper refill of each channel after firing of a droplet is inhibited resulting in misdirection or drop size variability. In one embodiment described therein, the ink-repellent coating is applied to the printhead array face while blowing high velocity filtered gas through the array. In this embodiment, the strong gas stream inhibits the ink-repellent material from entering the channels and coating the walls. This technique is highly effective for ensuring that only the front face receives a coating of repellent and not the channel walls, i.e., the inside surfaces of the printhead.

Thus, Badesha describes methods to avoid coating the interior channels with the solution, and in one embodiment uses pressurized air to prevent the solution from entering the channels. Badesha does not describe using the pressurized air to draw a coating solution through the printhead.

What is desired is a method of coating the ejectors of ink jet printheads with a uniform coating of ink-phobic material. Also desired is a method of coating the inside ejector surfaces of ink jet printheads with a uniform coating of ink-phobic material.

SUMMARY OF THE INVENTION

It is an object of the present invention to provide a method of coating the ejector and/or ejector surfaces of an ink jet printhead.

It is another object of the present invention to provide a method of coating the inside surfaces of the ejector or inside ejector surfaces of an acoustic ink jet printhead.

It is a further object of the present invention to provide uniform coatings of an ink-phobic coating.

It is still a further object of the present invention to provide a method of coating ink jet printheads that is economical and efficient.

It is a still further object of the present invention to provide a coating for the ejector and/or ejector surfaces of ink jet printheads exhibiting resistance to corrosive inks.

It is a still further object of the present invention to provide a printhead having an ejector coated with TEFLON® AF fluoropolymers.

These and other objects of the present invention are achieved by coating the ejector surfaces of an ink jet printhead with an ink-phobic coating and drawing the ink-phobic material through the inside of the ejector of an ink jet printhead.

DETAILED DESCRIPTION OF PREFERRED EMBODIMENTS

Figure 1:
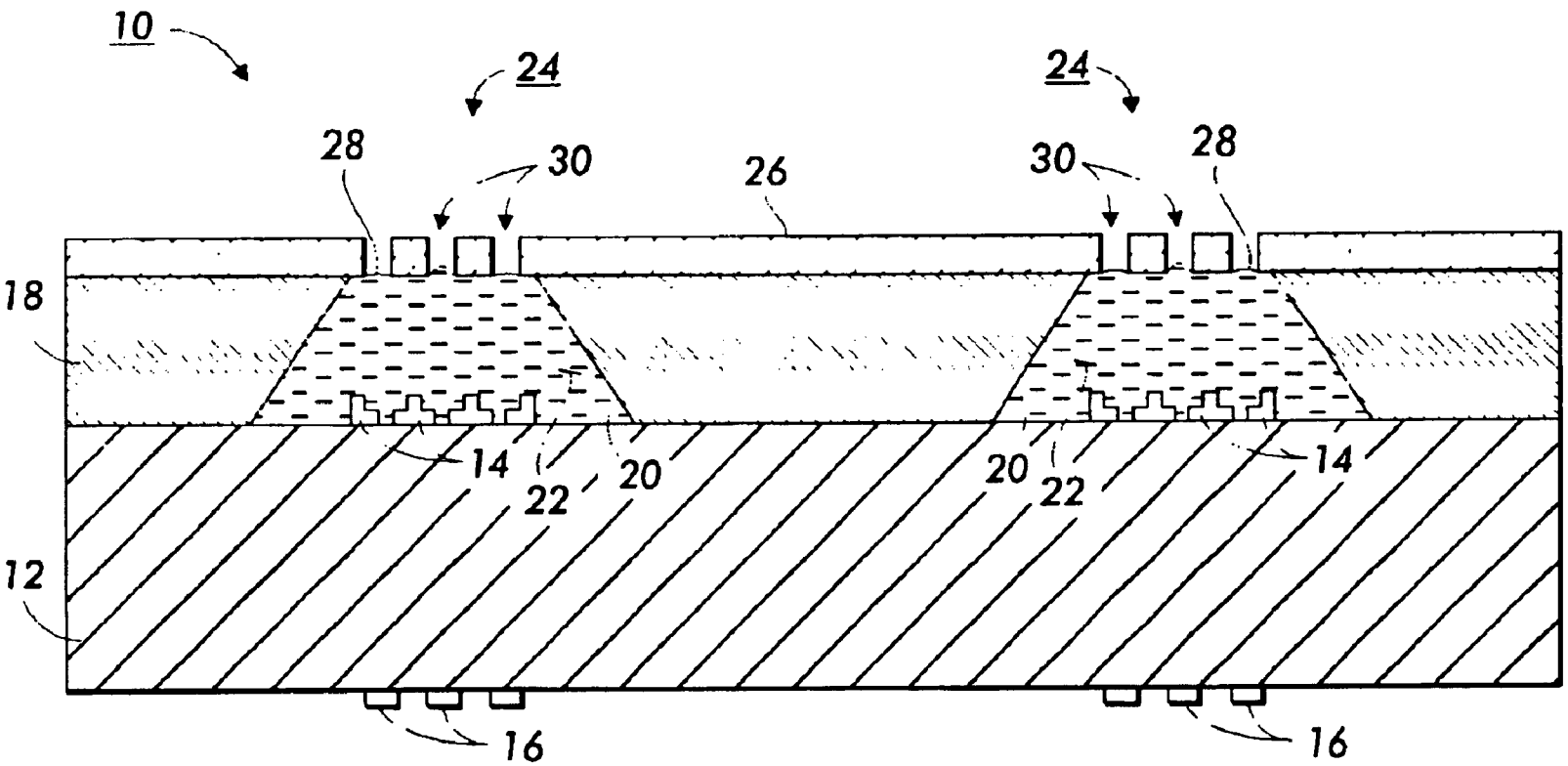
FIG. 1 shows a cross-sectional view of a droplet emitter 10 for an acoustically actuated printer.

The present invention is directed to a method of coating the ejector and/or ejector surfaces of an ink jet printhead with an ink-phobic coating. The present invention is further directed to an ink jet printhead having the ejector and/or ejector surfaces coated with the ink-phobic coatings. The present invention is further directed to coating the outside and the inside surfaces of the ejector of an acoustic ink jet printhead with an ink-phobic coating. In a preferred embodiment, the ink-phobic coating is applied to the outside and the inside surfaces of drop ejector apparatuses of an acoustic ink jet printhead. The present invention provides a method for uniformly coating the ejector and/or ejector surfaces of an ink jet print head with a uniform ink-phobic coating.

As used herein, the term "ink-phobic" means to be antagonistic, repellant or resistant to inks. Thus, ink-phobic means to be hydrophobic to water based inks and antagonistic to other inks such as, for example, wax-based inks or other inks that are water-based.

As used herein, the term "ejector" comprises the part of a printhead where ink or recording solution is expelled or ejected from the printhead. As used herein, the term "ejector surfaces" comprises the surfaces on a printhead coming into contact with the ink or recording solution as the ink or recording solution is expelled or ejected from the printhead. An ejector generally has openings, commonly referred to as apertures, through which ink or recording solution egresses. These openings or apertures have inside surfaces that contact ink or recording solution prior to the ejecting or expelling of the ink or recording solution. The present invention provides a method of coating both the inside surfaces and outside surfaces of ejectors. Examples of "ejectors" or parts having "ejector surfaces" include apertures, aperture plates, aperture arrays, liquid level control plates, etc. In a particularly preferred embodiment, a liquid level control plate is coated. The coating may be applied to a lip area and/or a sidewall area of the liquid level control plate. The coating may be applied on the whole lip area, including a demarcation point leading to the ink side of the liquid level control plate.

The method of the present invention includes applying the ink-phobic coating material to the ejector of the printhead and drawing the material through the ejector. Thus, both the inside and outside ejector surfaces are coated with the ink-phobic coating material. The ink-phobic material may be in a solution of solvent. The present invention overcomes significant problems in the prior art, i.e., the present invention provides a method of uniformly coating both the inside and outside surfaces of the ejectors of ink jet printheads.

U.S. Pat. No. 6,199,970 to Roy et al., incorporated by reference herein in its entirety, describes ink jet printheads which comprise ejectors and ejector surfaces which may be coated by the methods and coatings of the present invention.

Figure 2:
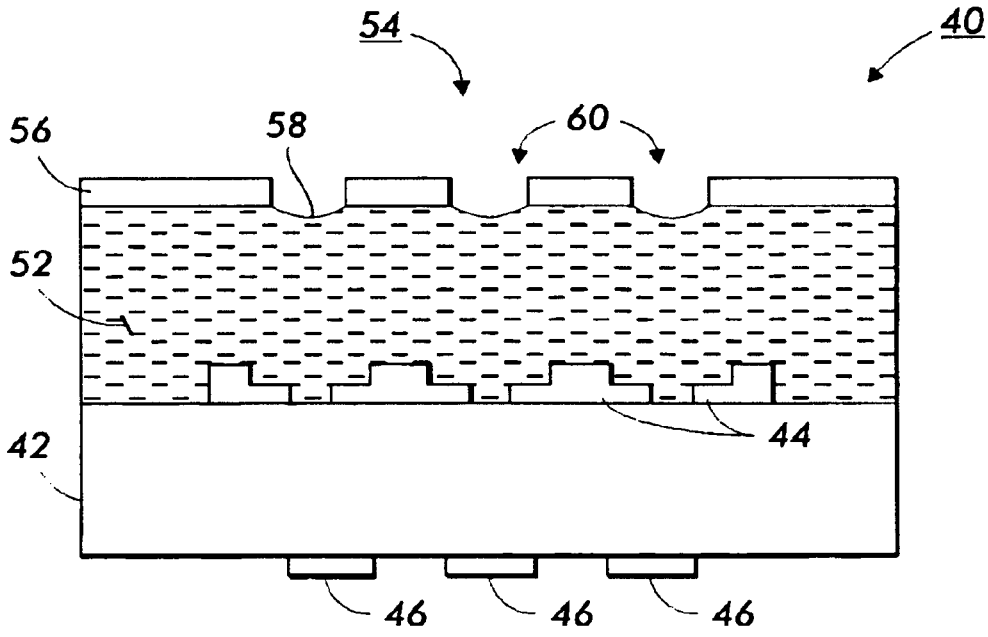
FIG. 2 shows a cross-sectional view of droplet emitter 40 for an acoustically actuated printer with a liquid level control and an array of apertures.

FIG. 1 and FIG. 2 show examples of printheads which comprise ejectors or ejector surfaces that may be coated by the method and with the ink-phobic coating of the present invention. Of course, any suitable ink jet printhead design may be used without restriction in the present invention. Further, although any material may be used for the ejector or ejector surfaces, stainless steel is preferred, e.g., stainless steel type 316.

As shown in FIG. 1, a droplet emitter (i.e. a printhead) 10 has a base substrate 12 with transducers 16 on one surface and acoustic lenses 14 on an opposite surface. Attached to the same side of the base substrate 12 as the acoustic lenses is a top support 18 with channels, defined by sidewalls 20, which hold a flowing liquid 22. Supported by the top support 18 is a capping structure 26 with arrays 24 of apertures 30. The transducers 16, acoustic lenses 14, and apertures 30 are all axially aligned such that an acoustic wave produced by a single transducer 16 will be focused. When sufficient power is obtained, a droplet is emitted from surface 28.

Shown in FIG. 2 is droplet emitter 40, another printhead which may be used with the methods and coating of the present invention. The droplet emitter 40 has a base substrate 42 with transducers 46 on one surface and acoustic lenses 44 on an opposite surface. Spaced from the base substrate 42 is a liquid level control plate 56. The base substrate 42 and the liquid level control plate 56 define a channel which holds a flowing liquid 52. The liquid level control plate 56 contains an array 54 of apertures 60. The transducers 46, acoustic lenses 44, and apertures 60 are all axially aligned such that an acoustic wave produced by a single transducer 46 will be focused by its aligned acoustic lens 44 at approximately a free surface 58 of the liquid 52 in its aligned aperture 60. When sufficient power is obtained, a droplet is emitted from surface 58.

Next, the ink-phobic coating of the present invention used to coat the ejectors and ejector surfaces will be described.

The ink-phobic coating formed on the ejectors and ejector surfaces of the print head must have favorable ink repellency properties and be sufficiently durable. An ink-phobic coating is necessary for the proper operation of the ink jet by preventing the improper wetting of the ejector surfaces of the acoustic ink jet printhead. The ink-phobicity of the coating may be determined by the measurement of the contact angle of water to the ink-phobic coating after application to a metal coupon. The contact angle of the water on the ink-phobic coating should be greater than about 70° initially and should have a minimum of about 40° after heating the ink to dryness.

For the novel coating method, any conventional ink-phobic coating material may be used without restriction. Suitable materials include, for example, fluoropolymers, perfluoropolymers, fluorelastomers, siloxane polymers, polyolefins, polystyrene, polyimide, polyamide imide, poly (methyl methacrylate) and polyacrylates.

TEFLON® AF 1600 and 2400 are preferred ink-phobic materials for use in the method and with the printhead of the present invention. TEFLON® AF 1600 and 2400 are amorphous co-polymers of perfluor(2,2-dimethyl-1,3-dioxole) (PDD) and tetrafluoroethylene (TFE) that are available from the E.I. du Pont de Nemours and Company Corporation and are particularly preferred for use in the ink-phobic coating of the present invention. These amorphous copolymers possess outstanding chemical resistance, thermal stability, electrical and mechanical properties as other TEFLON® fluoropolymers, but are amorphous. Since these copolymers are amorphous, they are soluble in perfluorinated solvents and may be applied by conventional coating methods. TEFLON® AF 1600 and TEFLON® AF 2400 are of similar chemical compositions, but have varied glass transition temperatures. The glass transition temperature of TEFLON® AF 1600 is 160° C., while the glass transition temperature of TEFLON® AF 2400 is 240° C.

Another preferred ink-phobic material for use in the method and with the printhead of the present invention is the dispersion SPEEDFILM-CX, ULTRA LOW-K IC DIELECTRIC, marketed by W. L. Gore and Associates of Eau Claire, Wis. This dispersion comprises 5–30% polytetrafluoroethylene (PTFE), 0–35% proprietary surfactant, less than 20% proprietary silane and less than 10% of other proprietary ingredients. This dispersion may be used without additional solvent.

Prior to the application of the ink-phobic coating, a primer, for example, a silane primer, may be optionally applied to the ejector or ejector surfaces. A particularly preferred primer is available from Lancaster Synthesis Co. and is 1H,1H,2H,2H-perfluorodecyltriethoxysilane, marketed under the trade name A-4040.

The ink-phobic coating and primer may be applied to the ejectors and ejector surfaces by any suitable method such as, for example, dip coating, spray coating, spin coating, flow coating, stamp printing, ink jet print coating and blade techniques. An air atomization device such as, for example, an air brush or automated air/liquid spray, may be used in spray coating. Particularly preferred airbrushes include models 2000VL and 2000H from Paasche Airbrush Company of Harwood Heights, Ill. Also, the air atomization device may be mounted on an automated reciprocator that moves in a uniform pattern to cover the surface of the ejectors and ejector surfaces with a uniform coating of the applied material. The use of a doctor blade is another preferred technique to apply the coating material. In flow coating, a programmable dispenser is used to apply the coating material. In ink jet print coating, a coating device with an ink jet print head is used to apply the coating material to the ejectors and ejector surfaces using ink jet processes.

In a preferred embodiment, the ink-phobic material in a solvent solution is applied onto the surface of an aperture plate. In this preferred embodiment, the side of the aperture plate with the openings with a larger dimension are facing the coating solution application side. The openings with the larger dimension may be, for example, about 240 microns by about 350 microns, while the openings with a smaller dimension may be, for example, about 80 microns by about 190 microns.

Solvents for use in the solution of the coating method of the present invention include fluorinated solvents from the 3M® Company such as FLUORINERT® brand solvents (FC-87, FC-72, FC-74, FC-77, FC-104, FC-75, FC-3283, FC-40, FC-5320, FC-43, FC-70, FC-5312 and/or mixtures thereof). Especially preferred solvents are FC-75, FC-77, FC-40 and/or mixtures thereof. The solvent solution may contain any suitable amount of the ink-phobic material, preferably for example about 1% to about 12% by weight of the ink-phobic material. Preferably, the solvent solution contains about 6% by weight of the ink-phobic material.

After applying the ink-phobic coating to the ejector of the printhead, a thin coating of the ink-phobic coating is on the front surface of the ejector, while often excess ink-phobic coating solution collects in the ejector, i.e., in the aperture openings of the ejector. A vacuum is then applied to the back side of the ejector such that the excess ink-phobic solution remaining in the ejector is drawn through and expelled from the back side of the ejector. Preferably, the vacuum applies a force of about 10 to about 20 inches of mercury to draw the ink-phobic solution through the ejector. In a particularly preferred embodiment, the ink-phobic solution is applied by spraying while the vacuum draws excess ink-phobic solution through the ejector.

Pressurized air may also be used to force the ink-phobic coating through the ejector. In this embodiment, after application of the ink-phobic coating to the ejector, pressurized air is applied to the front of the ejector to push the ink-phobic solution through the ejector and to the back side of the ejector.

The wet coating layer of ink-phobic solution is about 3 microns to about 150 microns thick. Preferably, the wet coating layer is about 8 microns to about 80 microns thick. Most preferably, the wet coating layer is about 30 microns to about 60 microns thick. The apertures of the aperture plate are covered with the ink-phobic coating and excess ink-phobic material is removed. In an especially preferred embodiment, excess ink-phobic material is removed by the use of a doctor blade. The doctor blade may be made from polyurethane with a metal support to maintain the straightness of the doctor blade.

The ejector with the ink-phobic material thereon is then heated to an appropriate temperature for drying and curing. Preferably, the ejector is heated at about 200° C. to about 300° C. for about 20 to about 60 minutes. After drying and curing, the ejector is placed in communication with the remainder of the printhead. The dried layer of ink-phobic material has a thickness of about 0.2 microns to about 10 microns. Preferably, the dried layer of ink-phobic material has a thickness of about 0.5 microns to about 5 microns.

An ink jet printhead comprising an ejector or ejector surfaces coated by the method of the present invention or with the ink-phobic coating of the present invention may be used with any suitable ink. Suitable inks may comprise an aqueous liquid vehicle, surfactants, and dyes. Suitable inks include those described in U.S. Pat. No. 6,255,383, incorporated by reference herein in its entirety.

The liquid vehicle can consist solely of water, or it can comprise a mixture of water and a water soluble or water miscible organic component, such as ethylene glycol, propylene glycol, diethylene glycols, glycerine, dipropylene glycols, polyethylene glycols, polypropylene glycols, amides, ethers, urea, substituted ureas, ethers, carboxylic acids and their salts, esters, alcohols, organosulfides, organosulfoxides, sulfones (such as sulfolane), alcohol derivatives, carbitol, butyl carbitol, cellusolve, tripropylene glycol monomethyl ether, ether derivatives, amino alcohols, ketones, N-methylpyrrolidinone, 2-pyrrolidinone, cyclohexylpyrrolidone, hydroxyethers, amides, sulfoxides, lactones, polyelectrolytes, methyl sulfonylethanol, imidazole, betaine, and other water soluble or water miscible materials, as well as mixtures thereof.

The ink compositions of the present invention may also contain a water insoluble dye. Examples of water insoluble dyes include C.I. Solvent Black 29, commercially available from Orient Chemical Co., Springfield, N.J., as SOLVENT DYE ORIENT BLACK 3808; C.I. Solvent Blue 70, commercially available from Orient Chemical Co. as SOLVENT DYE ORIENT BLUE 2606; C.I. Solvent Blue 25, commercially available from Orient Chemical Co. as SOLVENT DYE ORIENT BLUE BOS; C.I. Solvent Yellow 82, commercially available from Orient Chemical Co. as SOLVENT DYE ORIENT YELLOW 4120; C.I. Solvent Yellow 29, commercially available from Orient Chemical Co. as SOLVENT DYE ORIENT YELLOW 129; C.I. Solvent Red 49, commercially available from Orient Chemical Co. as SOLVENT DYE ORIENT PINK 312; and mixtures thereof. The dye is present in the ink in any desired or effective amount for obtaining the desired color, typically in an amount of from about 1 to about 10 percent by weight of the ink, preferably from about 2 to about 7 percent by weight of the ink, and more preferably from about 5 to about 6 percent by weight of the ink, although the amount can be outside of these ranges.

Examples of suitable surfactants include polyethylene oxide-polypropylene oxide-polyethylene oxide triblock copolymers, including those formed by the controlled addition of propylene oxide to the two hydroxyl groups of propylene glycol, followed by addition of ethylene oxide.

Other optional additives to the inks include biocides such as DOWICIL 150, 200, and 75, benzoate salts, sorbate salts, and the like, present in an amount of from about 0.0001 to about 4 percent by weight of the ink, and preferably from about 0.01 to about 2.0 percent by weight of the ink, pH controlling agents such as acids or, bases, phosphate salts, carboxylates salts, sulfite salts, amine salts, and the like, present in an amount of from 0 to about 1 percent by weight of the ink and preferably from about 0.01 to about 1 percent by weight of the ink, or the like.

The inks used with the method and ink-phobic coating of the present invention generally have a viscosity at room temperature (i.e., about 25° C.) of no more than about 10 centipoise, and preferably the viscosity is from about 1 to about 5 centipoise, more preferably from about 1 to about 4 centipoise, although the viscosity can be outside this range.

The inks used with the method and ink-phobic coating of the present invention can be of any suitable or desired pH. Typical pH values are from about 3 to about 11, preferably from about 5 to about 10, and more preferably from about 6 to about 8.5, although the pH can be outside of these ranges.

The following examples are intended to further illustrate the invention without necessarily limiting the invention. Examples I and II demonstrate the superior performance of the preferred ink-phobic coatings of the present invention, while Example III demonstrates an example method of applying such coatings to not only the outer surface of liquid level control plate, but also the inside surfaces of the apertures of the liquid level control plate. Example IV demonstrates an example method in which the coating solution is sprayed on while vacuuming occurs.

EXAMPLE I

A primer solution is first prepared. The solution contains A-4040 primer by 2% weight in 95% weight ethanol and 5% weight water. The solution of primer is coated on a stainless steel metal coupon (0.75"×1.75") by spin coating at 750 rpm followed by one hour of hydrolysis at a relative humidity greater than 50%. Next, TEFLON® AF 2400 is spin coated on the primed metal coupons at 1,000 rpm and dried at 260° C. for 30 minutes.

The contact angle of water on the surface of the coated coupons is measured before ink contact and after ink contact with heating for 16 hours at 80° C. and to ink dryness and after a rinse with ink solvent.

Cyan ink initially has a contact angle of 122°. After ink contact, the cyan has a contact angle of 122°. After rinse with solvent, the cyan ink has a contact angle of 116. Magenta ink has an initial contact angle of 122°. After ink contact, the magenta has a contact angle of 125°. After rinse with the solvent, the magenta ink has a contact angle of 121°. Yellow ink has an initial contact angle of 125°. After ink contact, the yellow ink has a contact angle of 120°. After rinse with the solvent, the yellow ink has a contact angle of 115°. Black ink has an initial contact angle of 122°. After ink contact, the black ink has a contact angle is 121°. After rinse with the solvent, the black ink has a contact angle of 121°. Thus, all of the metal coupons exhibit acceptable ink-phobicity with the coating of TEFLON® AF 2400.

EXAMPLE II

Next, the ink-phobically coated coupons are subjected to a hot ink soak test. The TEFLON® AF 2400 coated metal coupons are placed in hot ink at 80° C. for up to 18 days to simulate the aging effect of ink contact. The coated coupons are checked after five to seven days to determine whether the coating has blistered or peeled or degraded in any way. The process is repeated up to the 18 day limit. TEFLON® AF 1600 is applied onto stainless steel 316 metal plates without and with the primer and heated at 200° C. for 30 minutes. The coating maintained its ink-phobicity for 20 days of soak time in hot SYMPHONY 9 black ink at 80° C. The results of this test indicate that TEFLON® AF polymer is an acceptable ink-phobic coating material for ejector surfaces of acoustic ink jet printheads with stainless steel type 316 used as the metal composition in the fabrication of the head structure.

The TEFLON® AF polymer proves ink-phobic without and with primer and is able to maintain ink-phobicity after extended contact with ink.

EXAMPLE III

A coating solution of 6% by weight TEFLON® AF 1600 is applied to a hole pattern in an liquid level control plate with the liquid level control plate being supported such that there is nothing below the ink jet openings. The coated plate is placed on a flat sheet of absorbent material and the excess TEFLON® AF 1600 is removed by the use of a doctor blade from the liquid level control plate. The coated liquid level control plate is then placed onto a vacuum with the coated hole side facing up. The vacuum draws excess coating solution through the plate thus coating the inside walls and holes with the TEFLON® solution. The wet coating forms a layer about 30 microns thick on the liquid level control plate. The liquid level control plate is dried by heating and curing at about 200° C. for about 30 minutes.

EXAMPLE IV

A primer solution containing 1H,1H,2H,2H-perfluorodecyltriethoxysilane (PFDTES) from Lancaster Synthesis Inc. of Windham, N.H. is prepared from 0.5 grams PFDTES in 0.5 grams of water with 9.5 grams of ethanol. The primer solution is allowed to hydrolyze for about 1 hour.

The prepared PFDTES primer solution is spray coated onto the aperture side of a liquid level control plate using a model 2000VL airbrush from the Paasche Airbrush Company at an air pressure of about 1 lb, while the liquid level control plate is supported on a rigid metal plate having a slot for the drawn air and excess solution to travel through during vacuuming. The slot of the rigid metal plate is larger than the opening of the aperture. The rigid metal plate prevents the vacuum from distorting the straightness of the liquid level control plate during the coating process. A thin layer of the PFDTES primer is thus applied to the liquid level control plate by repeated passes using the air brush. The vacuum is applied to the back of the liquid level control plate and draws air and excess primer from the front of the liquid level control plate, through the apertures and to the back of the liquid level control plate. The liquid level control plate is dried by first air drying and a final drying at 80° C. for about 10 minutes.

An ink-phobic solution of TEFLON® AF 1600 in FC-75 solvent at 3.7 percent weight solids is prepared. The solution is then diluted with FC-75 solvent to obtain about a 1.2 percent weight solids solution having a viscosity sufficient for air atomization spray coating.

The ink-phobic solution comprising the TEFLON® AF 1600 solution is next applied by the air brush at 4 lbs air pressure to the front surface and walls of the apertures on the liquid level control plate, already coated with the primer. During the spray application of the ink-phobic solution onto the liquid level control plate, a light vacuum, about 15 inches of mercury, is applied to the back side of the liquid level control plate that is supported on the rigid metal plate having the slot. During the spray application process, the vacuum draws the fine liquid particles of the ink-phobic solution through the holes of the aperture plate such that the ink-phobic solution is applied onto the front and wall surface of the apertures, thus preventing the holes at the base of the apertures from clogging.

The liquid level control plate aperture is coated with about 150 repeated passes of the airbrush. The coating is allowed to air dry and then is cured by heating to 240° C. for about 30 minutes. The dried ink-phobic coating had a thickness of about 3 micrometers.

What is claimed is:

1. A method of applying an ink-phobic coating to an ejector of an ink jet printhead, comprising:

applying the ink-phobic material to an outer surface of the ejector, wherein the ejector comprises one or more openings through which ink is expelled or ejected, and drawing the ink-phobic material through the openings of the ejector to coat an interior of the ejector with the ink-phobic material, wherein a vacuum draws the ink-phobic material through the openings of the ejector.

2. The method of claim 1, further comprising heating the coated ejector to dry or cure the ink-phobic material.

3. The method of claim 1, wherein the vacuum draws the ink-phobic material through the ejector with a force of about 10 to about 20 inches of mercury.

4. The method of claim 1, wherein the ink-phobic material is a solution comprising about 1% by weight to about 12% by weight amorphous fluoropolymer.

5. The method of claim 4, wherein the amorphous fluoropolymer is a copolymer of perfluoro(2,2-dimethyl-1,3-dioxole) and tetrafluoroethylene.

6. The method of claim 1, wherein prior to applying the ink-phobic material to the outer surface of the ejector, a primer is first applied to the ejector.

7. The method of claim 6, wherein the primer is 1H,1H,2H,2H-perfluorodecyltriethoxysilane.

8. The method of claim 1, wherein the ejector comprises an aperture plate with apertures, wherein the apertures are coated with the ink-phobic coating.

9. The method of claim 1, wherein the vacuum is applied to a back side of the aperture plate, and wherein additional excess ink-phobic coating is drawn through to the back side of the aperture plate.

10. The method of claim 9, wherein the aperture plate has apertures on a front side of the aperture plate and the back side has openings larger than the apertures on the front side of the aperture plate.

11. The method of claim 1, wherein the printhead comprises a liquid level control plate.

12. The method of claim 1, wherein a contact angle of water on the ink-phobic coating is greater than about 70°.

13. The method of claim 1, wherein a contact angle of water on the ink-phobic coating is at least about 40° after the heating and curing.

14. The method of claim 1, wherein the ink-phobic material is applied to an outer surface of the ejector by an air atomization spray device.

15. The method of claim 1, wherein the ink-phobic material is applied to an outer surface of the ejector by an air atomization spray device while the vacuum draws the ink-phobic material through the openings of the ejector.

16. A method of applying an ink-phobic coating to an ejector of an ink jet printhead, comprising:

applying the ink-phobic material to an outer surface of the ejector, wherein the ejector comprises one or more openings through which ink is expelled or ejected, removing from the outer surface of the ejector an excess of the ink-phobic material applied thereto, and, subsequent to the removing step, drawing the ink-phobic material through the openings of the ejector to coat an interior of the ejector with the ink-phobic material.

17. The method of claim 16, wherein the removing excess ink-phobic material from the outer surface of the ejector comprises wiping the outer surface with a doctor blade.

18. A method of applying an ink-phobic coating to an ejector of an ink jet printhead, comprising:

applying the ink-phobic material to an outer surface of the ejector, wherein the ejector comprises one or more openings through which ink is expelled or ejected, and, after completion of the applying of the ink-phobic material.

subsequently forcing the ink-phobic material through the openings of the ejector to coat an interior of the ejector with the ink-phobic material.

19. The method of claim 18, wherein the subsequent forcing step comprises applying pressurized air to force the ink-phobic material through the openings of the ejector to coat the interior of the ejector with the ink-phobic material.

* * * * *